United States Patent [19]

Lee, Jr.

[11] 4,099,475

[45] Jul. 11, 1978

[54] METHOD OF TROUBLE-SHOOTING CAN PRESSES

[75] Inventor: Harry W. Lee, Jr., Chesterfield County, Va.

[73] Assignee: Reynolds Metals Company, Richmond, Va.

[21] Appl. No.: 709,904

[22] Filed: Jul. 29, 1976

[51] Int. Cl.[2] ..... B21D 51/26

[52] U.S. Cl. ..... 113/116 QA; 113/120 R; 113/120 H; 29/407

[58] Field of Search ..... 113/1 G, 120 R, 120 H, 113/116 QA, 7 R; 29/407; 73/52, 94, 102

[56] References Cited

U.S. PATENT DOCUMENTS

| | | | |
|---|---|---|---|
| 2,950,620 | 8/1960 | Magill | 73/102 |
| 3,462,015 | 8/1969 | Tysver et al. | 73/52 |

*Primary Examiner*—Michael J. Keenan

*Attorney, Agent, or Firm*—Glenn, Lyne, Gibbs & Clark

[57] ABSTRACT

A method of trouble-shooting wherein an increase in a can's body and neck failures is correlated with prior failure-mode experience and used to indicate corresponding types of can-press malfunctions.

2 Claims, 5 Drawing Figures

FIG. 3
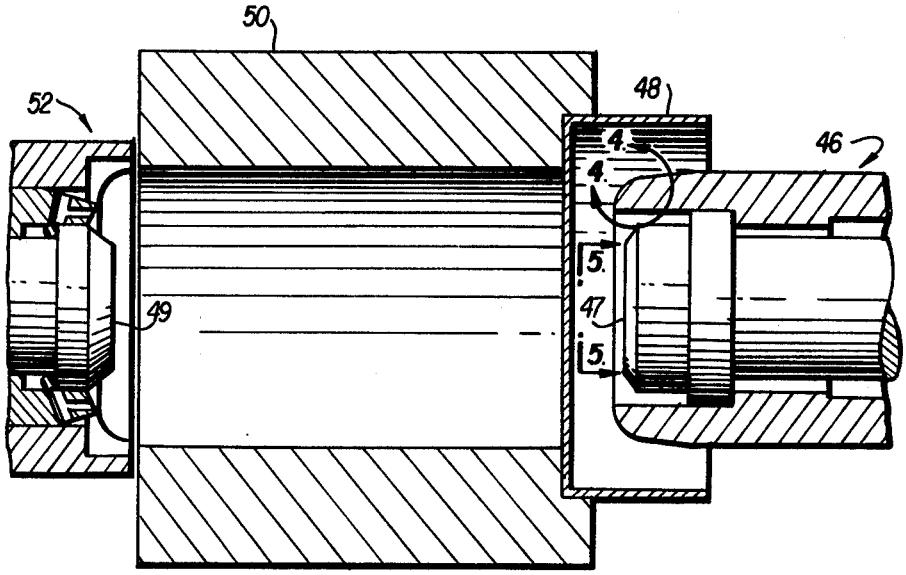
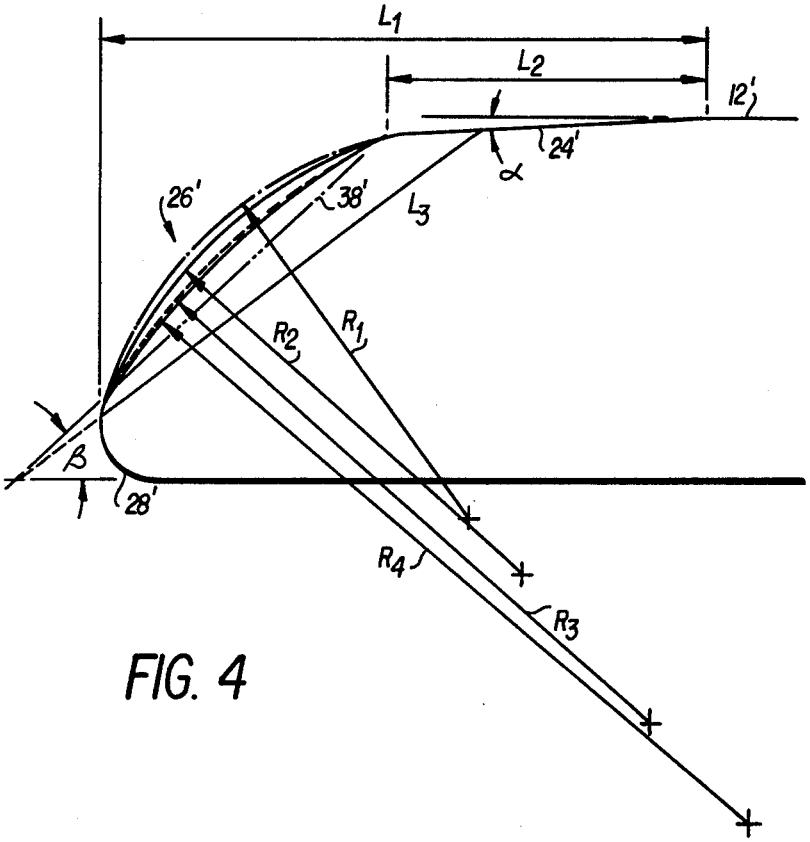
FIG. 4

METHOD OF TROUBLE-SHOOTING CAN PRESSES

BACKGROUND OF THE INVENTION

Containers of the "drawn-and-ironed" type exhibit three main points of failure when subjected to compressive loads such as occur when the cans are dropped either during normal handling, or when dropped from a storage position into a receiver portion of an automatic vending machine, for example, such failures tend to occur in the can's neck portion or its sidewall or in the can's bottom. A container is about to be described, however, wherein such failures occur most frequently in the container's bottom portion; and, moreover, can absorb relatively large quantities of energy before catastrophically failing in the sense that the container is no longer suited for its intended purpose.

According to the instant invention, when it is known that a properly constructed can should fail in its bottom-portion, neck and body failures are used to indicate specific structural defects in the cans and related malfunction in the can's press.

SUMMARY

A container will be described wherein its failure mode is predominantly in the container's bottom portion. An increase in the body and neck failures in such cans is then used to trouble-shoot a can press and assist in determining the types of press malfunctions which give rise to such body and neck failures.

BRIEF DESCRIPTION OF THE DRAWINGS

The foregoing and other features and advantages of this invention will be apparent from the more particular description of preferred embodiments thereof as illutrated in the accompanying drawings wherein the same reference numerals refer to the same elements throughout the various views. The drawings are not necessarily intended to be to scale, but rather are presented so as to illustrate the principles of the invention in clear form.

In the drawings.

Figure 5:
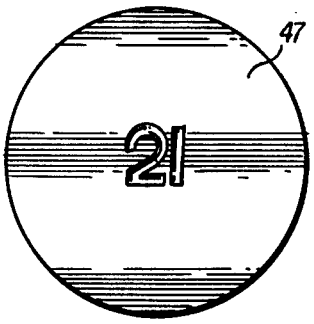

FIG . 2 is a fragmentary cross sectional illustration of the bottom portion of a container of the invention;

FIG. 3 is a schematic illustration of a drawing and ironing machine;

FIG. 4 is a greatly enlarged fragmentary view of a portion of a punch taken along the arc 4—4 in FIG. 3; and;

FIG. 5 is a view of a portion of a punch face taken along the lines 5—5 in FIG. 3.

DETAILED DESCRIPTION

Figure 1:
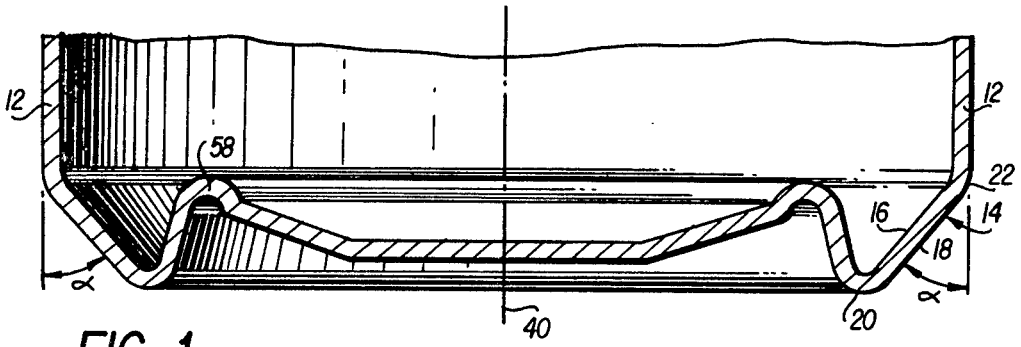
FIG. 1 PRIOR ART
FIG. 1 is a fragmentary cross sectional schematic illustration of a prior-art type of can.

FIG. 1 illustrates a prior art type of container wherein a cylindrical side wall 12 is joined at an angle $\alpha$ to a first frustoconical portion 14 having substantially flat inner and outer surfaces 16 and 18. In this regard, portion 14 extends between an outwardly convex annular bottom bead 20 and a transition point 22 between the side wall 12 and the first frustoconical portion 14.

Figure 2:
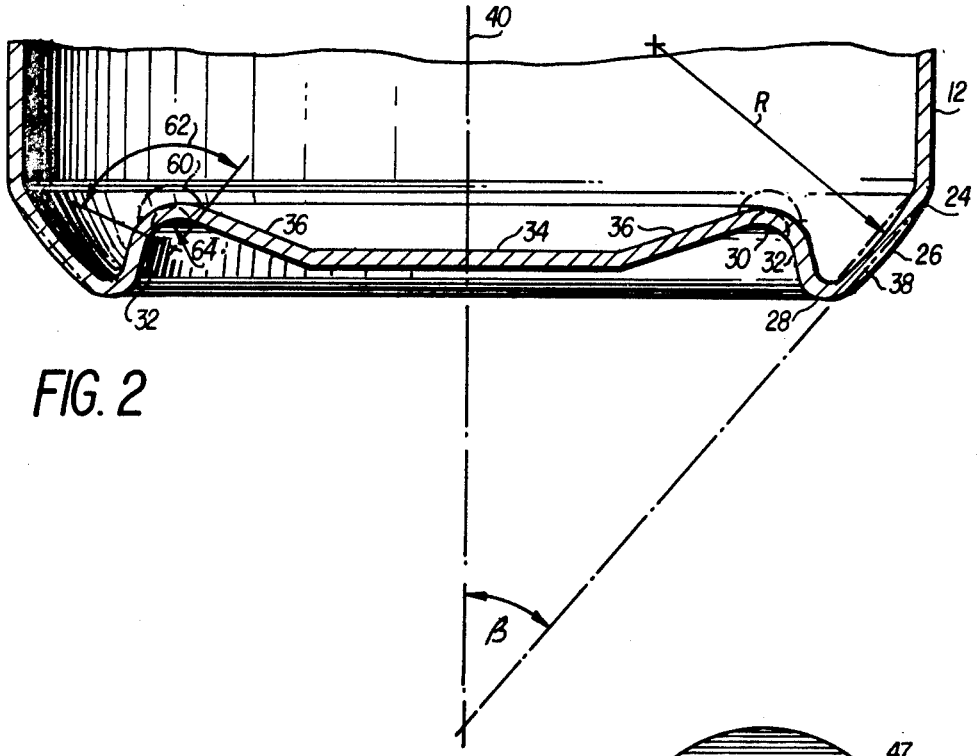

FIG. 2 illustrates the bottom portion of a container of the invention. Therein, the side wall 12 is joined to a first frustoconical portion 24 which, in turn, is joined to a semi-torroidal portion 26 which, in turn, is faired into a first annular portion 28. The first annular portion 28 is attached to a second annular portion 30 by a second frustoconical section 32 — the other side of the second annular portion 30 being joined to a flat central portion 34 by a third frustoconical portion 36.

The semi-torroidal portion 26 is outwardly convex from a cord 38 extending between the first frustoconical portion 24 and the lower annular portion 28 — the chord 38 making an angle $\beta$ with the container's axis 40. In this respect, in connection with preferred embodiments of the invention, the radius R of the semi-torroidal portion 26 and the angle $\beta$ were varied between certain limits as will now be discussed in connection with a punch that is used to form the structure of FIG. 2.

The schematic illustration of FIG. 3 represents a punch 46 about to drive a "cup" 48 through a draw-and-ironing structure 50 and against a bottom former 52. Except as will now be described, the FIG. 3 elements are conventional and will not be described further. The draw-and-ironing structure 50, for example, includes conventional redrawing dies, ironing rings, pilot rings, and the like, but those elements form no part of the instant invention.

FIG. 4 represents a portion of the punch 46 which forms the semi-torroidal section 26 of the can-bottom illustrated in FIG. 2. In this regard, portions of the punch in FIG. 4 which correspond to the can-bottom of FIG. 2 have their correspondance indicated by prime signs added to similar reference numerals. For example, the can's side wall 12 corresponds to side wall 12' of the punch; the can's first frustoconical portion 24 corresponds to frustoconical punch portion 24'; the can's semi-torroidal section 26 corresponds to semi-torroidal punch portion 26'; and, the can's arcuate portion 28 corresponds to punch portion 28'.

The frusto conical portion 24' is at an angle gamma to the side wall 12'. In this regard, best results can be expected when $\gamma$ is within the range of 1°to 6°. Similarly, best results can be expected when L2, the axial length of the first frustoconical portion 24', is between 0.150 inches and 0.600 inches for a pressurized container of the conventional "beer can" type. In these respects, the numeric ratio $Q_1$ of gamma (in degrees) /$L_2$ (in inches) should be between about 1 and 60, but is most preferrably about 12. If $Q_1$ becomes too small, excessive tool wear is likely to increase; and if $Q_1$ becomes too large the containers energy absorbive capabilities are diminished.

The semi-torroidal portion 26' is arcuate about cord 38' which, when extended, makes an angle $\beta$ with the container's axis. When $\beta$ is increased, the dimension $L_2$ also increases if other parameters remain fixed. Similarly, if $\beta$ decreases (other parameters remaining constant) the dimension $L_2$ becomes smaller, as the cord increases in length. This is indicated by the dimension $L_3$ which represents the cord 38' in any of its various positions depending upon the changes of the angles $\beta$ and $\gamma$.

In the above regard, the radius of the semi-torroidal portion 26 ' should be between 0.200 and 0.700 for a pressurized container of the conventional beercan type. Generally speaking, however, the numeric ratio $Q_2$ of $\beta$ (in degrees) /R (in inches) should be between about 35 and 300. Containers having $Q_2$ ratios of less than about 35 appear to have body and neck failures sooner than bottom failures; and, containers having $Q_2$ ratios over 300 appear to have relatively low initial deformation points. The most preferred $Q_2$ ratio is about 85 which is in the lower end of the above range of $Q_2$ ratios rather than in the middle as might otherwise be expected.

The ratios of L1/R1 ($Q_3$) and L1/L2 ($Q_4$) appear to be of somewhat less significance. A preferred range for $Q_3$, however, is between about 0.5 and 2.5 with excellent results being obtained where $Q_3$ is about 0.965. Similarly, a preferred range for $Q_4$ is between about 1.35 and 3.25 with excellent results being obtained when $Q_4$ is about 1.93.

Containers of the type just described were subjected to testing to determine their energy absorptive abilities and their tendencies to undergo bottom deformation prior to failure of their sidewalls and necks. Test results of preferred containers were then compared with containers having bottom configurations corresponding to that of FIG. 1. Based on those test results, it was determined that cans of the above-described type having semi-torroidal sections such as 26' had substantially higher energy absorption capabilities when compared with the prior art "control" cans. In one preferred embodiment, for example, where $Q_1$ was 12, $Q_2$ was 84; $Q_3$ was 0.965; and $Q_4$ was 1.93; the container's energy absorption capabilities were 537 percent higher than the average energy absorption capabilities of the control cans which, themselves, have outstanding strength characteristics when compared with similar characteristics of certain prior art types of cans. One of the tested cans of the invention had even higher energy absorption capabilities, but its $Q_2$ ratio was at the low end of the preferred range and was not as reliable about undergoing adequate bottom deformation prior to side wall failure. Hence, although it is possible to vary the above parameters to obtain increased energy absorption capabilities, this is done at the expense of failure-mode predictability which will now be discussed.

As indicated above, it has usually been difficult to determine the type of container-defect or press-defect that has led to container failures. Primarily this was because failure modes were quite random. By structuring the containers in accordance with the instant invention, however, it has been found that most (roughly 95 percent) of the containers will collapse in their bottom portions before they will fail in either the neck or the side wall. Additionally, it has been found that this factor can be used to trouble-shoot the presses if the cans are periodically tested as they are fabricated. In this regard, as cans are pressed, certain ones are randomly selected and subjected to a compression test to determine the can's failure mode. As a series of cans from a given press are thusly tested, a higher than normal percentage of neck failures is used to indicate, for example, that the necks are too thin and/or the press's necking dies are worn.

Similarly, if a significant percentage of the cans exhibit body failures it is used to indicate, for example, that the container's walls are too thin, indicating an abnormality in the profile of the punch.

In the same light, if the container's bottom collapses at an unacceptably low compressive force, this provides an indication, for example, of a defect in the nose of the punch. Where containers of the FIG. 1-type are compression-tested, however, the failure modes are so unpredictable that the above described testing and trouble-shooting method is not practical.

As noted above, particularly in connection with machine trouble-shooting, it is desirable to be able to identify the press which constructed a given can. A problem in the past, however, has been that embossed or punched markings on the containers have led to stress concentrations which produced premature can failure. But, in the instant case it has been found that bottoms of cans can be "air" or "lubrication" embossed without appearing to cause detrimental stress concentrations.

In the above regard, FIG. 5 illustrates the bottom-forming end 47 of the punch 46 in FIG. 3 wherein the number "2" is etched therein while the corresponding "die" portion 40 of the bottom former 52 remains blank. Nevertheless, when a can bottom is rammed between the marked and unmarkedpress elements, it is acceptably marked by the air or lubricant that is trapped between the two press elements.

Similarly, a suitable press identifying indicia can be engraved or embossed on the bottom-former die element 49 and the corresponding punch-fore 47 left blank. In both cases the can-bottom is suitably air or lubrication embossed without appearing to cause detrimental stress concentrations.

The above described structure provides containers which not only have high energy absorption capabilities, but have their failure modes concentrated mostly in the container's bottom portions. In this manner, it is less difficult to control can quality; easier to determine the causes of can defects; and, because of the increased energy absorbing capabilities, possible to make such containers from relatively thin stock. Additionally, however, it should be noted that the FIG. 2 bottom-structure does not include a strengthing bead such as 58 in FIG. 1. If it is desired to further increase the strength of the FIG. 2 can, however, this is accomplished by adding a strengthening bead such as 60 in FIG. 2. This semi-torroidal bead 60 is of substantial arcuate length and, in effect is substituted for the second annular portion 30 located between the second and third frustoconical portions 32 and 36. When viewed in cross section, for example, the bead 60 subtends an arc 62 of greater than 100° and preferably on the order of 180°.

The semi-torroidal bead 60 has a radius 64 which, for a typical beer-type container, may range between 0.030 and 0.187, but is preferably about 0.060. In this regard, the use of beads such as 60 has resulted in cans being able to have their pressures increased by as much as 5 psi; or if preferred, the stock thickness can be correspondingly reduced.

While the invention has been particularly shown and described with reference to preferred embodiments thereof, it will be understood by those skilled in the art that various changes in form and details may be made therein without departing from the spirit and scope of the invention. For example, the flat bottom portion 34 can be selectively adjusted downwardly as described in Ser. No. 656,045 to increase the container's volume as it otherwise tends to decrease due to wear of the punch 46. It should be noted in this respect that this volume adjustment is made without any alteration in the container's overall top-bottom dimension. Hence, a single punch can be used to produce far more cans than would otherwise be the case, but the thusly produced cans nevertheless continue to meet the relatively exacting dimensional requirements for cans that are used in automatic dispensing machines.

I claim:

1. A method of trouble-shooting a can press including the steps of:

producing cans from said press wherein said cans have a predetermined normal failure mode;

correlating given non-normal types of failure modes of said cans with given malfunctions of said can press;

subsequently selecting cans from said can press when said can press is believed to be operating normally and subjecting said subsequently selected cans to destructive testing to determine whether the resulting failure modes are normal or non-normal; and, in the event said resulting failure mode is non-normal, determining the press malfunction corresponding to the non-normal failure mode determined during the previous step.

2. The method of claim 1 wherein said normal failure-mode is bottom failure.

* * * * *